United States Patent [19]

Yoshida et al.

[11] Patent Number: 4,749,679

[45] Date of Patent: Jun. 7, 1988

[54] HEAT SENSITIVE RECORDING MATERIALS

[75] Inventors: Shohei Yoshida; Toshiaki Endo; Sumitaka Tatsuta; Toshimasa Usami, all of Shizuoka, Japan

[73] Assignee: Fuji Photo Film Co., Ltd., Kanagawa, Japan

[21] Appl. No.: 870,490

[22] Filed: Jun. 4, 1986

[30] Foreign Application Priority Data

Jun. 4, 1985 [JP] Japan ..... 60-119862

[51] Int. Cl.[4] ..... B41M 5/18

[52] U.S. Cl. ..... 503/208; 427/150; 428/402.21; 428/402.22; 428/913; 503/209; 503/215; 503/226

[58] Field of Search ..... 346/208, 209, 215; 427/150–152; 428/402.2, 402.21, 402.22, 913; 503/208, 209, 215, 225, 226

[56] References Cited

U.S. PATENT DOCUMENTS 4,644,376 2/1987 Usami et al. ..... 346/215

*Primary Examiner*—Bruce H. Hess

*Attorney, Agent, or Firm*—Sughrue, Mion, Zinn, Macpeak and Seas

[57] ABSTRACT

This invention discloses a heat sensitive recording material having a heat sensitive layer on a support; either of a color forming material or a developer which are contained in the heat sensitive layer is encased in a microcapsule. Since a plasticizer for a wall material of the microcapsule and a compound having an effect to depress the melting point of at least one member out of developers, a color forming reaction is carried out smoothly under a recording condition, therefore, a density of an obtained image is sufficient. Especially good results are obtained when a macromolecule substance selected from a group of polyurethane, polyurea, polyamide, polyester and polycarbonate is used as a wall material of the microcapsule. A coloring reaction assistant may be contained in any place of the heat sensitive layer.

A preferable plasticizer can be selected from a group of phenols, alcohols, ureas, sulfonamides, carbamates and aromatic methoxy compounds.

26 Claims, No Drawings

HEAT SENSITIVE RECORDING MATERIALS

BACKGROUND OF THE INVENTION (a) Field of the Invention

The present invention relates to a heat sensitive recording matrerial. More particularly, it relates to a heat sensitive recording material which has an excellent preservability before it is used for recording and a high color density at the time of thermal recording.

(b) Prior Art Description

Recently, a thermal recording method is rapidly spreading in such fields as facsimile and printers due to the following merits, although a heat sensitive paper used for this purpose often has a poor preservability before and after recording.

(1) Development is not needed.

(2) If the support is paper, its quality is nearly the same as that of ordinary paper.

(3) The material is easy to handle.

(4) It has a high color density.

(5) The recording unit used is simple and inexpensive.

(6) No noise is caused on recording.

As a heat sensitive recording material, heat sensitive paper which can be used for multi-coloring has been developed in recent years. For example, it includes the one utilizing diazosulfonate or a combination of diazosulfonate and leuco coloring system. However, in the case of this type of paper, it is necessary to differentiate the thermal reactivity by selecting the compounds which conduct coloring reactions. Therefore, it has been inevitable that the coloring materials which could be used for such a purpose were highly limited in number, resulting in a heavy restriction on designing and manufacturing recording materials.

Also, though the heat sensitization recording has been so far mostly applied to literal recordings, there is increasing a demand for picture recordings with gradation such as hard copies of television pictures. In this case, gradation is expressed either by setting the recording density at a certain level and altering the recording area or by setting the recording area to a certain size and altering the recording density. Since the former not only deteriorates the resolving power but also has a limitation on expressing half-tone, the latter is an excellent method.

However, although usual heat sensitive paper is usable for the former method, it is not suitable for the latter which needs printing of an intermediate density. In other words, it has been difficult to supply heat sensitive recording materials which have a reasonable changing rate of the coloring density in response to an applied energy so that the coloring density can change gradually with a certain smoothness.

For example, in the case of heat sensitive recording paper of a leuco coloring system, it is prepared by finely dispersing a leuco dye and a phenolic developer in a size of microns, mixing and applying the components to a paper support. When this paper is heated with a thermal head, the above-mentioned coloring components fuse and mix to form color. Therefore, it is necessary to differentiate the temperature characteristics of each kind of particles or layered coatings on paper in order to let the coloring density change in response to the applied energy. This is not an easy procedure.

As a method for solving the above problems, we have already proposed a heat sensitive recording material which has an improved preservability (Japanese Patent Application (OPI) No. 190886/84 (the term 'OPI' as used herein means an "unexamined published application")). In this method, at least one component which relates to a coloring reaction is enclosed as a core substance and a wall is prepared around the core by a polymerization reaction to form a microcapsule. The capsules are contained in a recording layer.

We improved this method further and proposed a heat sensitive recording material and/or a multi-colored heat sensitive recording material which can reproduce a half-tone. This is accomplished by combining various microcapsules of which wall materials are varied so as to give them different thermal responses and, as a result, a picture density can be varied (Japanese Patent Application Nos. 89781/84 and 99489/84). However, there was a weak point in such a material using microcapsules because it was difficult to secure a sufficiently high thermal coloring density.

SUMMARY OF THE INVENTION

Accordingly, the first object of the present invention is to propose a heat sensitive recording material with a high thermal coloring density.

The second object of the present invention is to propose a heat sensitive recording material having an excellent fresh preservability as well as an excellent processability.

Then, the third object of this invention is to propose a heat sensitive recording material which can reproduce a half-tone in response to an applied energy and at the same time, which can secure the maximum coloring density.

The above described objects were accomplished by heat sensitive recording materials prepared by encasing in a microcapsule at least one member selected from a coloring agent which conducts a coloring reaction by being heated, a developer and, if necessary, a coloring reaction assistant; a combination of a color former and a coloring reaction assistant; or a combination of a developer and a coloring reaction assistant, and coating the obtained capsules on a support as a heat sensitive layer. In each case, the materials include in at least one of inside or outside the microcapsules or in their walls a plasticizer for the wall material of the capsule a compound which has an effect to lower the fusing point of at least one component out of developers and color reaction assistance, both of which (developer and coloring reaction assistants) relate to the coloring reaction.

In the case of the heat sensitive recording material of the present invention, components related to the coloring reaction are isolated by microcapsules so that its fresh preservability before recording is excellent and moreover, the preservability of the recorded image is also excellent since the image can be fixed by photo irradiation.

Also, plasticization of microcapsules and fusing of a developer and/or a coloring reaction assistant proceed quickly due to heating, whereby the movement of the substances related to a coloring reaction is made smooth, thus accomplishing quick recording by heating as well as a high picture density.

Further it is possible to mutually relate the coloring reaction rate at the time of heating and the applied energy by suitably selecting and adjusting the wall material of microcapsules, its plasticizer, and a melting point depressant of the developer and/or coloring reaction assistant, whereby half-tone tints can be reproduced.

It goes without saying that such effects of the present invention are also obtained in the case of a multi-colored heat sensitive reacording material which uses one or more of the color formers.

DESCRIPTION OF THE PREFERRED EMBODIMENTS

Examples of a color former used in the present invention which develops a coloring reaction under heating are either basic colorless dyes such as leuco dyes or diazo compounds. A developer in the present invention means a compound to make a color former develop its coloring reaction by reacting with the color former which has not developed its coloring yet. For example, if the color former is a diazo compound, the developer is to be a so-called coupler.

Leuco dyes are almost colorless dyes which develop colors by donating electrons or accepting protons such as acids. They have a partial structure of lactone, lactam, sultone, spiropirane, ester or amide, etc. Among these days those used in the present invention are the compounds of which ring contained as partial structures would be opened or cleft by contacting a developer.

Examples of the leuco dyes which can be used in the present invention are crystal violet lactone, benzoyl leuco methylene blue, malachite green lactone, rhodamine B lactam, 1,3,3-trimethyl-6'-ethyl-8'-butoxyindolinobenzospiropirane, 2-dimethylamino-7-methoxyfluorane, 3-dimethylamino-7-methoxyfluorane, 2-methyl-3-anilino-7-cyclohexyl-N-methyl-aminofluorane, and 2-chlor-3-anilino-7-diethylaminofluorane.

There are known various developers which develop a coloring reaction on heat fusing with basic colorless dyes, and they can be used in the present invention. For example, as developers for leuco-dyes, phenol compounds, organic acids or their metal salts, oxybenzoate, etc. are preferable and especially phenols and organic acids which have a low solubility in water at 60°–200° C. are desirable.

The phenol compounds which can be used in the present invention are, for example, 4,4'-isopropyridenediphenol (bisphenol A), p-t-butylphenol, 2,4-dinitrophenol, 3,4-dichlorophenol, 4,4'-methylene-bis(2,6-di-t-butylphenol), p-phenylphenol, 4,4-cyclohexylidenediphenol, 2,2'-methylenebis(4-t-butylphenol), 2,2'-methylenebis (α-phenyl-p-cresol)thiodiphenol, 4,4'-thiobis(6-t-butyl-m-cresol), sulphonyl-diphenol, 1,1-bis(4-hydroxyphenyl)-n-dodecane, 4,4-bis(4-hydroxyphenyl)-1-ethyl pantane acid ester, and p-t-butylphenol-formalin condensate or p-phenylphenol-formalin condensate.

As organic acids or their metal salts, 3-t-butyl salicylic acid, 3,5-t-butyl salicylic acid, 5-α-methylbenzyl salicylic acid, 3,5-di-α-methylbenzyl salicylic acid, 5-α-γ-dimethyl-α-phenyl-γ-phenylpropyl salicylic acid, etc. and their zinc salts, lead salts, aluminium salts, magnesium salts or nickel salts, etc. are useful.

Examples of oxybenzoate are p-oxy-ethyl benzoate, p-oxy-butyl benzoate, p-oxy-heptyl benzoate and p-oxybenzil benzoate etc.

These compounds are used after solid-dispersing them with a sand mill, etc. using water soluble macromolecules as protective colloids.

In this invention, it is possible to use diazo compounds as color formers. In this case, photo-fixation can be carried out and they are preferable in this invention.

Diazo compounds are, as is well known, diazonium salts which is expressed by a general formula of $ArN_2{+}X^-$. While they form colors by developing a coupling reaction with a coupling component, they decompose by absorbing light (In the formula, Ar represents a substituted or nonsubstituted aromatic part, $N_2{+}$ represents a diazonium group and $X^-$ represents acid anion). Any of these compounds can be suitably chosen for the use in the present invention.

Examples of the diazo compounds (diazonium salts) which can be used in this invention are as shown below.

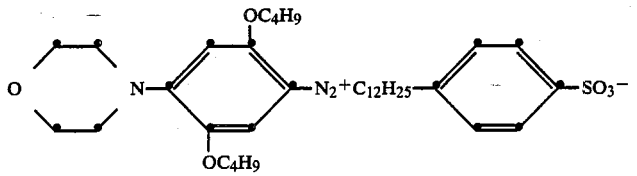

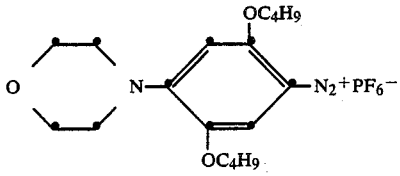

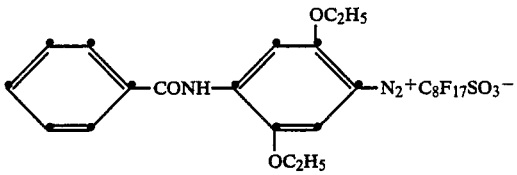

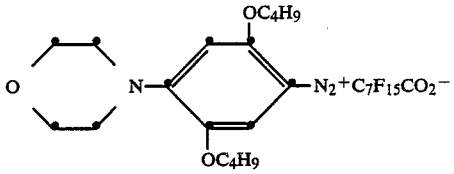

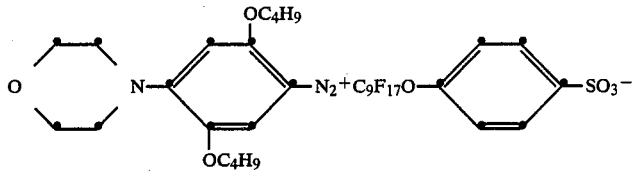

The developers which react with the above diazonium salts to develop colors are the compounds (couplers) which form colors by coupling with diazonium salts in a basic atmosphere. Examples of the couplers used in this invention are resorcinol, phloroglucin, 2,3-dihydroxynaphthalene-6-sodium sulfonate, 1-hydroxy-2-naphthoic acid morpholino-propylamide, 2-hydroxy-3-naphthoic acid-N-dodecyl-oxy-propylamide, 2-hydroxy-3-naphthoic acid tetradecylamide, acetanilide, acetoacetanilide, benzoylacetanilide, 1-(2',4',6'-trichlorophenyl)-3-anilino-5-pyrazolone, 1-phenyl-3-phenylacetoamide-5-pyrazolone, etc. An image of any color tone could be obtained by using two or more of these couplers.

Although a coloring reaction assistant is not always necessary in the present invention, it is used for the purpose of accelerating color formation in a reaction system containing a diazonium salt as a color former.

As such a coloring reaction assistant, basic substances which are non-soluble or little soluble in water or substances which release basic substances by being heated can be listed.

Examples of the basic substances used in the present invention are nitrogen containing compounds such as organic ammonium salt, organic amine, amide, urea or thiourea and its derivatives, thiazoles, pyrroles, pyrimidines, piperazines, guanidines, indoles, imidazoles, imidazolines, triazoles, morpholines, piperidines, amidines, formadines, pyridines, etc. More particularly, they are ammonium acetate, tricyclohexylamine, tribenzylamine, octadecyl-benzylamine, stearylamine, arylurea, thiourea, methylthiourea, arylthiourea, ethylenethiourea 2-benzylimidazole, 4-phenylimidazole, 2-phenyl-4-methylimidazole, 2-undecyl-imidazoline, 2,4,5-trifuryl-imidazoline 1,2-diphenyl-4,4-dimethyl-2-imidazoline, 2-phenyl-2-imidazoline, 1,2-ditolyl guanidine, 1,2-dicyclohexylguanidine, 1,2,3-tricyclohexyl-guanidine guanidine trichloroacetate, N,N'-dibenzyl-piperadine, 4,4'-dithiomorpholine, morpholinium trichloro-acetate, 2-amino-benzothiazole, 2-benzoylhydrazino-benzothiazole, etc. These basic substances can be used in combination of two or more.

As substances which release basic substances under heating and can be used in the present invention, for example, arylurea, thiourea, ethylenethiourea, methylthiourea, arylthiourea, guanidine trichloroacetate morpholinium trichloroacetate, etc. can be enumerated.

Any of the main components used in this invention such as a color former, a developer and, if necessary, a coloring reaction assistant can be used singly as a core subastance in a microcapsule, or a combination of the two of them which develop no coloring reaction each other can be enclosed in the microcapsule. In the latter case, the two components can be contained either in the same microcapsule or in different microcapsules. Also, if three components are to be contained as a core substance, since they can not be placed all in one microcapsule, those which may not be placed in the microcapsule are applied in a heat sensitive layer outside the capsule.

Especially, when a color former is contained in a microcapsule, the fresh preservability of the obtained heat sensitive material is desirable and it is a preferred embodiment in the present invention.

It is preferable that an amount of the color former to be used in this invention is 0.05–5.0 g/m$^2$. As to the developer and coloring reaction assistant, in either case of being contained in a microcapsule or in a heat sensitive layer outside the capsule, the former is used in an amount of 0.1–10 parts by weight and the latter in an amount of 0.1–20 parts by weight per one part by weight of the color former.

When the color former, developer and coloring reaction assistant are not encased in a microcapsule, it is preferred that they are solid-dispersed using a sand mill, etc. together with a water soluble macromolecule. In this case, the preferable water soluble macromolecule is the one which is used for preparing the microcapsule. Its concentration is to be 2–30% by weight, and the color former, developer and coloring reaction assistant are used in an amount of 4–40% by weight each based on the macromolecule solution.

A particle size of the components is desired to be 10 microns or smaller than that.

The following is a description on the microcapsule used in the present invention. In this invention, a reactive substance which is encased as a core substance in the microcapsule is dissolved or dispersed in water using an organic solvent insoluble in water and emulsified. Then a microcapsule wall is formed by polymerization. The organic solvent used in this case is preferred to be those having a boiling point of 180° C. or higher. They are, for example, phosphate, phthalate, fatty acid amide, alkylated biphenyl, alkylated terphenyl, chlorinated paraffin, alkylated naphthalene, diarylethane, etc.

More particularly, they are tricresyl phophate, diphenylcresyl phosphate, trioctyl phosphate, octyldiphenyl phosphate, tricyclohexyl phosphate, dibutyl phthalate, dioctyl phthalate, dilauryl phthalate, dicyclohexyl phthalate, butyl oleate, diethylene glycol dibenzoate, dioctyl sebacinate, dibutyl sebacinate dioctyl adipate, trioctyl trimellitate, acetyltriethyl citrate, octyl maleate, dibutyl maleate, isopropyl biphenyl, isoamyl biphenyl, chlorinated paraffin, diisopropyl naphthalene, 1,1-ditolylethane, 2,4-di-t-aminophenol, N,N-dibutyl-2-butoxy-5-t-octylaniline, etc.

Among these, ester solvents such as dibutyl phthalate, diphenylcresyl phosphate, tricresyl phosphate, diethyl phthalate, dibutyl maleate, etc. are more desirable. In the present invention, when a wall of a macromolecular substance is formed around the oil drop obtained by emulsifying a core substrance containing a reactive substancesuch as a color former, etc. to produce a microcapsule, the reactant to form a macromolecular substance is added inside and/or outside the oil drop. Example of such a macromolecular substance are a polyurethane, polyurea, polyamide, polyester, polycarbonate, urea-formaldehyde resin, melamine resin, polystyrene, styrenemethacrylate copolymer, styrene-acrylate copolymer, gelatin, poly(vinylpyrrolidone), poly(vinylalcohol), etc. These macromolecularsubstances can be used as a combination of two or more in the present invention.

Also, among the above substances, polyurethane, polyurea, polyamide, polyester, polycarbonate, etc. are preferred in this invention. Especially, polyurethane and polyurea are preferable.

The present method of preparing a wall of a microcapsule by polymerizing the reactant from the inside of an oil drop is desirable since it is possible to form capsules of a uniform diameter within a short period of time, which is suitable for producing a recording material with an excellent fresh preservability.

The above method and examples of the compounds are, as briefly explained below, described in the specifications of U.S. Pat. Nos. 3,726,804 and 3,796,669.

When the polyurethane is used as a material for a capsule wall, a polyisocyanate and the second substance (e.g., a polyol and a polyamine) which reacts with the polyisocyanate to form the wall are mixed into an oily liquid to be capsuled. The mixture is dispersed and emulsified in water, and then the temperature of the resultant emulsion is raised to let the reaction to form a macromolecule proceed around the surface of oil drops. In this case, it is possible to let the oily liquid an auxiliary solvent which has a high dissolving power and a low boiling point.

The polyisocyanate used for forming capsules and the polyol as well as the polyamine, etc. which react with the polyisocyanate are disclosed in U.S. Pat. Nos. 3,281,383, 3,773,695 & 3,793,268, Japanese Patent Publication Nos. 40,347/73 & 24,159/73, and Japanese Patent Application (OPI) Nos. 80,191/73 & 84,086/73. The disclosed examples can be also used in the present invention.

A catalyst such as tin salt can be used to accelerate the urethane forming reaction.

Especially, when the polyisocyanate is used as a substance (1) and the polyol as a substance (2), a heat sensitive material having an excellent fresh preservability is obtainable. Also it is possible to suitably alter the heat permeability of the reactive substance by choosing the combination of the above two substances.

The polyol which is effectively used in the present invention and reacts with the polyisocyanate is described in Japanese Patent Application (OPI) No. 49,991/85. Also, a macromolecular membrane formed by the reaction between water and the polyisocyanate is desirable in the present invention.

In the present invention, it is possible to form microcapsules by using a water soluble macromolecule. This macromolecule can be any of anion, nonion and amphoteric water soluble macromolecules, and it can be either natural or synthetic. Examples of such a macromolecule are those having $—COO^-$ or $—SO_3^-$ group, etc. More specific examples of a natural anion macromolecule are a gum arabic, an alginic acid, etc. and those of a semi-synthetic one are a carboxymethylcellulose, a phthalized gelatin, a sulfated starch, a sulfated cellulose, a lignin sulfonic acid, etc. Synthetic water soluble macromolecules are, for example, copolymers of a maleic anhydride system (including hydrolyzed ones), polymers and copolymers of an acrylic acid system (including metacrylic acid ones), polymers and copolymers of vinyl benzene sulfonic acid system, carboxy modified polyvinyl alcohol, etc. Amphoteric compounds are gelatin, etc.

The above-described water soluble macromolecules are used as an aqueous solution of 0.01–10% by weight. In the present invention, microcapsules can be produced from an emulsion containing the component to be microcapsuled in an amount of 0.2% by weight or more regardless of the production method.

The diameter of a microcapsule used in this invention is adjusted to be 20 microns or less. Generally if the diameter becomes larger than 20 microns, a quality of imaging gets deteriorated. Especially, when the heating with a thermal head is carried out on the side coated with microcapsules, it is preferable to adjust the diameter to 8 microns or less in order to avoid the fog caused by pressure.

The microcapsules produced as explained above are not those which have been traditionally used in heat sensitive materials. They were destroyed by heat or pressure to let a reactive substance contained in them contact with another reactive substance outside them, and the two substances were caused to develop a coloring reaction. On the other hand, in the present invention, reactive substances inside as well as outside the microcapsules are heated mainly to make the wall of the capsules permeable so that a coloring reaction is to be carried out.

In other words, according to the present invention, coloring characteristics are controlled by adjusting the glass transition point of the microcapsule wall. Therefore, by selecting the combination of the wall materials mentioned later and a modifier of the glass transition point, it is possible to produce microcapsules having walls with different glass transition points. Thus, many intermediate colors can be accomplished by choosing the combination of diazo compounds with different hues and coupling components or the combination of leuco dyes and their developers in addition to the above combination. As explained so far, the present invention is not limited to monochromatic paper. It can be applied to dichromatic or multi-colored heat sensitive paper or the paper suitable for recordidng pictures having gradation.

When the combination of a diazo compound and a coupling component is used in the present invention, it is possible either to carry out photo-irradiation after their thermal coloring to fix the image by photodecomposing the diazo compound in areas where no coloring is needed, or on the contrary, to uniformly heat them after the imagewise photo-irradiation so as to cause thermal coloring in non-irradiated areas.

A plasticizer used in the present invention has effects of plasticizing the wall material of a microcapsule and lowering its glass transition point. Also, a melting point depressant is effective in lowering the melting point of a developer and/or a coloring reaction assistant. Due to these effects, compounds related to a coloring reaction become able to permeate through the microcapsule wall only by being heated a little, whereby sensitivity is improved.

As a material for the microcapsule wall, those which conduct hydrogen bonding between molecular chains such as the above mentioned polyurea, polyurethane, polyamide, etc. are mostly used in this invention. In this case, the glass transition point of the wall can be lowered by breaking the hydrogen bonds between those molecular chains.

The glass transition point in the present invention can be calculated from the peak temperature of tan δ which is obtained by the following formula using VIBRON DDV-II Type (Trademark) (manufactured by Toyo Baldwin Kabushiki Kaisha).

$$\tan \delta = \frac{\text{Dinamic loss of the modulus of elasticity}}{\text{Dinamic store of the modulus elasticity}}$$

A plasticizer used in this invention is preferred to be those which can lower the glass transition point of the microcapsule wall to 80°–150° C., especially to 100°–130° C.

According to this invention, the plasticizer for the microcapsule wall and the melting point depressant for the developer and/or the coloring reaction assistant can be the same compound or different ones.

Examples of a compound having both functions as a plasticizer as well as a melting point depressant are hydroxy compounds, carbamic acid ester compounds, sulfonamide compounds, aromatic methoxy compounds, etc.

Specific examples of hydroxy compounds are phenol compounds such as p-t-butylphenol, p-t-octylphenol, p-α-cumylphenol, p-t-pentylphenol, m-xylenol, 2,5-dimethylphenol, 2,4,5-trimethylphenol, 3-methyl-4-isopropylphenol, p-benzylphenol, o-cyclohexylphenol, p-(diphenylmethyl)phenol, p-(α,α-diphenylethyl)- phenol, o-phenylphenol, p-hydroxy ethyl benzoate, p-hydroxy butyl benzoate, p-hydroxy benzyl benzoate, p-methoxyphenol, p-butoxyphenol, p-heptyloxyphenol, p-benzyl-oxyphenol, 3-hydroxydimethyl phthalate, vanillin, 1,1-bis(4-hydroxyphenyl)dodecane, 1,1-bis(4-hydroxyphenyl)-2-ethyl-hexane, 1,1-bis(4-hydroxyphenyl)-2-methyl-pentane, 2-t-butyl-4-methoxyphenol, 2,2'-dihydoxy-4-methoxybenzophenone, etc. A preferable phenol compounds are expressed by the following general formula;

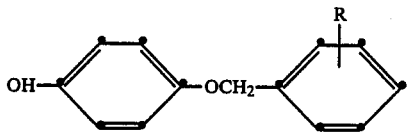

wherein, R is a hydrogen atom or an alkyl group. The best phenol is p-benzyloxyphenol.

Special examples of alcoholic compounds are 2,5-dimethyl-2,5-hexanediol, resorcinol-di(2-hydroxyethyl)ether, resorcinol-mono(2-hydroxyethyl)ether, salicylic alcohol, 1,4-di(hydroxyethoxy)benzene, p-xylenediol, 1-phenyl-1,2-ethanediol, diphenyl methanol, 1,1-diphenyl ethanol, 2-methyl-2-phenyl-1,3-propanediol, 2,6-dihydroxymethyl-p-cresolbenzyl ether, 2,6-dihydroxymethyl-p-cresolbenzyl ether, 3-(o-methoxyphenoxy)-1,2-propanediol, etc.

Specific examples of carbamate compounds are N-phenyl ethyl carbamate, N-phenyl benzil carbamate, N-phenyl phenethyl carbamate, benzil carbamate, butyl carbamate, isopropyl carbamate, etc.

Specific examples of sulfonamides are p-toluene sulfonamide, o-toluene sulfonamide, benzene sulfonamide, N-(p-methoxyphenyl)-p-toluene sulfonamide, N-(p-chlorophenyl)-p-toluene sulfonamide, N-(o-chlorophenyl)-p-toluene sulfonamide, N-(p-tolyl)-p-toluene sulfonamide, N-(o-tolyl)-p-toluene sulfonamide, N-(o-hydroxyphenyl)-p-toluene sulfonamide, N-benzyl-p-toluene sulfonamide, N-(2-phenetyl)-p-toluene sulfonamide, N-(2-hydroxyethyl-p-toluene sulfonamide, N-(3-methoxypropyl)-p-toluene sulfonamide, N-(p-tolyl)sulfonamide, N-(o-tolyl)sulfonamide, N-(p-methoxyphenyl)sulfonamide, N-(o-methoxy)sulfonamide, N-(p-chlorophenyl)sulfonamide, N-(o-chlorophenyl)sulfonamide, N-(2,4-xylil)sulfonamide, N-(p-ethoxyphenyl)sulfonamide, N-benzyl methane sulfonamide, N-(2-phenoxyethyl)methanesulfonamide, 1,3-bis(methanesulfonylamino)benzene, 1,3-bis(p-toluene sulfonylamino)-propane, etc. A preferable sulfonamide is expressed by the following general formula;

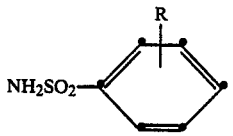

wherein R is a hydrogen atom or an alkyl group. The best sulfonamide is p-toluensulfonamide.

Aromatic methoxy compounds are, for example, 2-methoxy benzoate, 3,5-dimethoxyphenyl acetate, 2-methoxy naphthalene, 1,3,5-trimethoxybenzene, p-dimethoxybenzene, p-benzyloxymethoxy benzene, etc.

The above compounds can be used singly or as a combination of two or more. Preferable plasticizers are hydroxyl compounds. Especially p-benzyloxyphenol, p-t-butylphenol, p-xylilenediol, and 2,6-dimethylphenol are suitable.

When a plasticizer is included in a capsule or in its wall, its amount is to be 0.01–5.0 parts by weight per one part by weight of the wall material. Especially it is desirable to be 0.04–1.0 parts by weight. In the case of adding to the outside of capsules, the amount of the plasticizer is preferred to be 0.01–10 parts by weight per one part by weight of the wall material. Especially 0.10–5.0 parts by weight are suitable.

As explained in the above, the plasticizer for the wall material and the melting point depressant for the developer, etc. can be different compounds. In this case, the plasticizer for polyurea, polyurethane and other materials for microcapsule walls are as below:

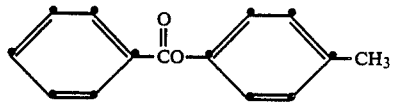

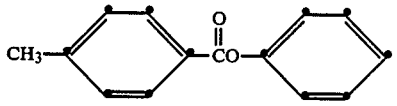

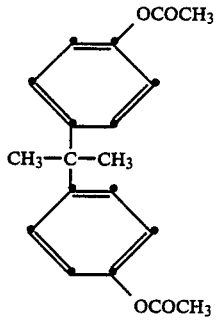

$nC_{18}H_{37}NHCONHZ$

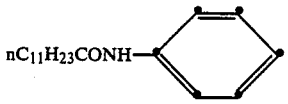

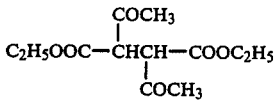

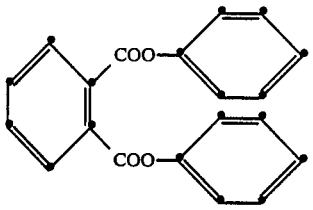

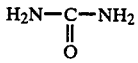

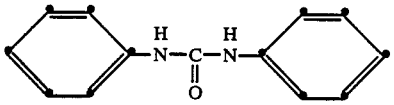

-continued

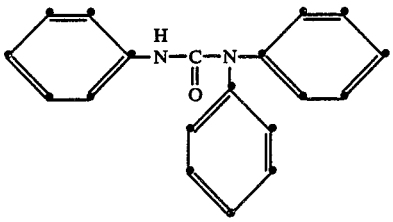

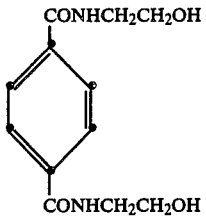

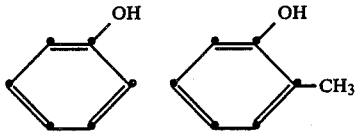

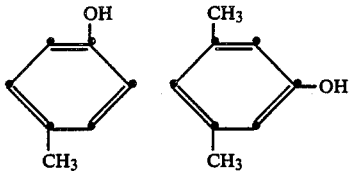

While, the examples of a compound which acts as melting point depressant on the developer such as 2-hydroxy-3-naphthoic acid amilide and/or the coloring reaction assistant such as triphenylguanidine are listed below.

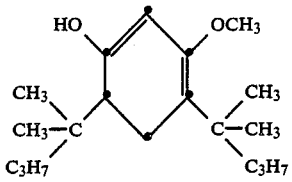

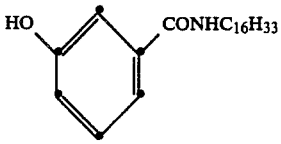

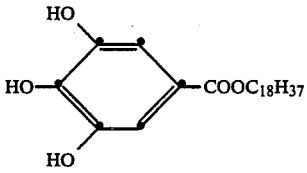

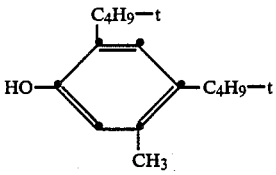

-continued

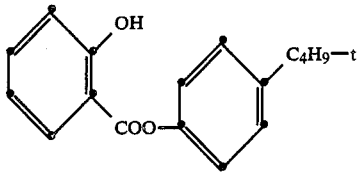

$C_{17}H_{35}CONHOH$

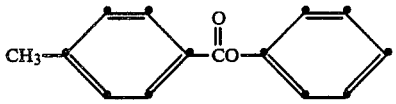

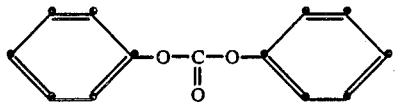

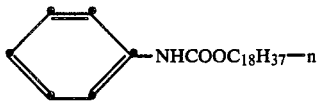

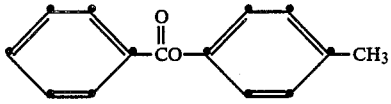

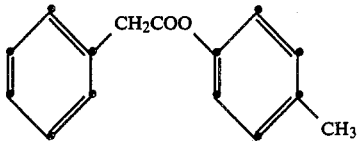

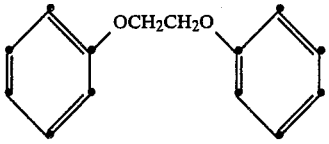

These melting point depressants are used in an amount of 0.1–2 parts by weight per one part of the developer and/or coloring reaction assistant of which melting points are to be lowered. Particularly, the range of 0.5–1 parts by weight is suitable. It is preferable to use the melting point depressant and the developer of which melting point is to be lowered in the same place. If they are added to different places, the amount to be added had better be increased to 1–3 times of the above amount.

To the heat sensitive recording material of the present invention, pigments such as silica, barium sulfate, titamium oxide, aluminium hydroxide, zinc oxide, calcium carbonate, etc. or fine powders of stiyrene beads, urea-melamine resin, etc. can be added for the purpose of preventing sticking the heat sensitive recording material to a thermal head and improving characteristics for describing.

Also, such a sticking can be prevented by adding metal soaps. Their amounts to be used are 0.2–7 g/m$^2$.

The heat sensitive material of the present invention can be coated using a suitable binder. As a binder, various emulsions of poly vinyl alcohol, methyl cellulose, carboxymethyl cellulose, hydroxypropyl cellulose, gum arabic, gelatin, polyvinyl pyrroridone, casein, styrene-butadiene latex, acrylonitrile-butadiene latex, polyvinyl acetate, poly acrylic ester, ethylene-vinyl acetate copolymer, etc. are used. Their amount to be used is 0.5–5 $g/m^2$ as a solid matter.

In addition, as an acid stabilizer, citric acid, tataric acid, oxalic acid, boric acid, phosphoric acid, pyrophosphoric acid, etc. can be added in this invention.

The heat sensitive recording material of the present invention is produced by preparing a coating solution which contains main components such as a color former, a developer, etc. and other additives, coating a support such as paper, synthetic resin films, etc. with the obtained solution via a bar coating, blade coating, air knife coating, gravure coating, roll coating, spray coating, dip coating, etc. and drying to form a heat sensitive layer containing a solid matter of 2.5–25 $g/m^2$. In other method, it is possible to produce a layered coating type: main components such as a developer, a coloring reaction assistant or other additives are added as core substances of a microcapsule or solid-dispersed or they are dissolved to make an aqueous solution, and then mixed to prepare a coating solution. The obtained solution is coated on a support and dried to form a precoated layer containing a solid matter of 2–10 $g/m^2$. Further, a main component such as a color former and other additives are added as core substances of a microcapsule or solid-dispersed, or they are dissolved as an aqueous solution, and then mixed to prepare a coating solution which was coated over the previous precoated layer and dried to constitute a coated layer containing a solid matter of 1–15 $g/m^2$. The heat sensitive recording material of this layered type can have a layered coating which is prepared by reversing the above procedures. In any cases, coating of the layers can be carried out either one by one or at the same time. Such a heat sensitive recording material of a layered coating type is desirable since it is especially excellent in its long-term fresh preservability.

As a support, neutral paper sized with a neutral sizing agent such as alkylketene dimer and having the pH 6–9 (the method to measure pH is described in Japanese Patent application (OPI) No. 14281/80) is advantageous in its long-term preservability.

Also, for preventing the permeation of a coating solution into paper and improving the contact between a thermal recording head and a heat sensitive recording layer, the paper described in Japanese Patent Application (OPI) No. 116687/82 as $$\frac{\text{Stöckigt Sizining degree}}{(m^2)^2} \geqq 3 \times 10^{-3}$$

and having a Beck smoothness of not less than 90 seconds is advantageous.

The following papers are also used in the present invention and give good results:

- paper described in Japanese Patent Application (OPI) No. 136492/83 and having an optical surface roughness of not more than 8μ and a thickness of 40–75μ
- paper described in Japanese Patent Application (OPI) No. 69091/83 and having a density of not more than 0.9 $g/cm^3$ and an optical contact rate of not less than 15%
- paper described in Japanese Patent Application (OPI) No. 69097/83, manufactured from the pulp which was beaten so as to make its Canadian Standard Filtration (JIS P8121) not less than 400 cc, and treated to prevent the permeation of the coating solution
- paper described in Japanese Patent Application (OPI) No. 65695/83 which is prepared by coating the glossy surface of base paper manufactured by Yankee Machine and has improved coloring density and resolving power
- paper described in Japanese Patent Application (OPI) No. 35985/84 which is prepared by corona treatment of base paper and has improved the characteristics for coating In addition to the above supports, those used in the field of ordinary heat sensitive recording paper can be used as a support in the present invention.

The heat sensitive recording materisl of this invention can be used as printer paper for a facsimile and an electronic computer which need a high speed recording. When thermal printing is done, the print can be fixed by being exposed to the light to let the unreacted color former decompose. Moreover, the material can be used as copying paper of a thermal development type.

EXAMPLES

Examples are to be described below. However, the present invention is not restricted by them. "Part" used to express the amount to be added means "part by weight."

EXAMPLE 1

Two parts of the under-mentioned diazo compound and 18 parts of an addition product of xylilenediisocianate and trimethylol propane (3:1) were added and dissolved to a mixed solvent of 24 parts of dibutyl phthalate and 5 parts of ethyl acetate. The resulting solution of the diazo compound was mixed with an aqueous solution in which 3.5 parts of polyvinyl alcohol, 1.7 parts of gelatin and 58 parts of water were being dissolved. The mixture was emulsified and dispersed at 20° C. to prepare an emulsion of an average particle diameter of 3μ. Ten parts of water were added to the obtained emulsion, which was then heated up to 60° C. with stirring. After 2 hours, a capsule solution containing the diazo compound as a core substance was obtained.

(diazo compound)

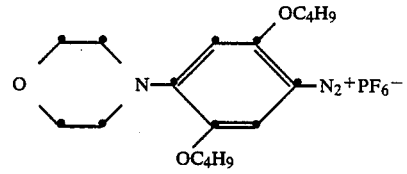

Then, 20 parts of 2-hydroxy-3-naphthoic acid-3-morpholinopropylamide were added to 100 parts of a 5% polyvinyl alcohol aqueous solution and dispersed for about 24 hours with a sand mill to obtain a dispered solution of a coupling component having an average particle diameter of 3μ.

Further, 20 parts of p-benzyloxyphenol were added to 100 parts of a 5% polyvinyl alcohol aqueous solution and dispersed for about 24 hours with a sand mill to obtain a dispersed solution.

Fifteen parts of the dispersed solution of a coupling component and 30 parts of the dispersed solution of p-benzyloxyphenol were added to 50 parts of the capsule solution of the diazo compound in the above to prepare a coating solution. This coating solution was bar-coated on smooth paper of a fine quality (50 g/m$^2$) using a coating rod so as to make the dry weight of the coating 20 g/m$^2$. Then the coating was dried for 30 minutes at 45° C. to obtain a heat sensitive recording material.

The image density was determined according to the under-mentioned method using the obtained heat sensitive recording material. The results are shown in Table 1.

On the other hand, 20 parts of an addition product of xylilenediisocianate and trimethylpropane (3:1) were dissolved in 30 parts of ethyl acetate. The obtained solution was bar-coated on a polyethylene sheet to let them react in water at 40°–60° C. The coating was peeled off and air dried at 24° C. and 64% RH for one day to obtain a film with a thickness of 10–20μ. After soaking this film in a 20% methanol solution of p-benzyloxyphenol for 30 hours, the film was air dried for one day at 24° C. and 64% RH. Thus, a sample for determining the glass transition point of a capsulewall material was obtained.

The results of determining the glass transition point of the obtained film sample according to the under-mentioned test method and the result of determining the melting point of a 1:1 mixture of 2-hydroxy-3-naphthoicacid-3-morpholinopropylamide (a coupling component) and p-benzyloxyphenol are shown in Table 1.

(1) Image density

Thermal recording was carried out upon a heat sensitive recording material using G III Mode of HIFAX 700 (manufactured by Kabushiki Kaisha Hitachi Seisakusho). The recording was fully exposed and fixed using Ricopy super dry 100 (manufactured by Kabushiki Kaisha Ricoh).

The image density which is a blue density of the obtained recorded image was measured using Macbeth reflection densitometer.

(2) Determination of the glass transition point

Dinamic store of the modulus of elasticity (E′) and Dinamic loss of the modulus of elasticity (E″) of the film samples using VIBRON DDV-II (manufactured by Toyo Baldwon K.K.) were measured and tan $\delta = E''/E'$ was calculated. The temperature which gave the maximum value of tan $\delta = E''/E'$ regarded to be the glass transition point.

The heating rate at this time was 2° C./min.

(3) Determination of the melting point

The mixture was tested using scanning type differential thermal calorimeter DSC-II manufactured by Perkin Elmer Co. Ltd.) at the heating rate of 10° C./min.

EXAMPLE 2

Two parts of the under-mentioned diazo compound and 18 parts of an addition product of xylilenediisocyanate and trimethylolpropane (3:1) were added and dissolved in a mixed solvent of 24 parts of dibutyl phthalate and 5 parts of ethyl acetate. The resulting solution of the diazo compound was mixed with an aqueous solution containing 3.5 parts of polyvinyl alcohol and 1.7 parts of gelatin dissolved in 58 parts of water, and emulsified and dispersed at 20° C. to obtain an emulsion of an average particle diameter of 3μ. Ten parts of water were added to the emulsion, which was heated up to 60° C. with stirring. After 2 hours, a capsule solution containing the diazo compound as a core substance was obtained.

(diazo compound)

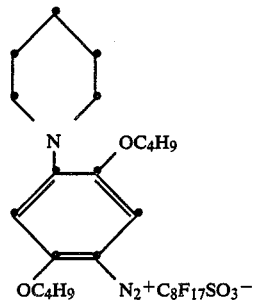

Then, 20 parts of 2-hydroxy-3-naphthoic acid anilide were added to 100 parts of a 5% polyvinyl alcohol aqueous solution and dispersed for about 24 hours with a sand mill to obtain a dispersed solution of a coupling component having an average particle diameter of 3μ.

Further, 20 parts of triphenylguanidine were added to 100 parts of a 5% polyvinyl alcohol aqueous solution, and dispersed for about 24 hours with a sand mill to obtain a dispersed solution of triphenylguanidine having an average particle diameter of 3μ.

Twenty parts of p-benzyloxyphenol were added to 100 parts of a 5% polyvinyl alcohol aqueous solution and dispersed for about 24 hours with a sand mill to obtain a dispersed solution of p-benzyloxyphenol having an average particle diameter of 3μ.

Fifty parts of the capsule solution of the diazo compound were added with 15 parts of the dispersed solution of a coupling component, 15 parts of the dispersed solution of triphenyl-guanidine and 30 parts of the dispersted solution of p-benzyloxyphenol to prepare a coating solution. This coating solution was bar-coated on smooth paper of a fine quality (50 g/m$^2$) using a coating rod so as to make the dry weight of the coating 20 g/m$^2$. Then the coating was dried for 30 minutes at 45° C. to obtain a heat sensitive recording material.

The results of determining the image density according to the same manner as in Example 1 using the obtained heat sensitive recording material and that of measuring the melting point of a 1:1 mixture of triphenylguanidine and p-benzyloxyphenol are shown in Table 1.

EXAMPLE 3

A heat sensitive recording material was prepared in the same manner as in Example 2 except using 2,4-dibutyl resolcine and urea instead of p-benzyloxyphenol of Example 2 and the image density was measured.

Then, samples for determining the glass transition point of the capsule wall material were prepared according to the same manner as in Example 1 using urea instead of p-benzyloxyphenol, and the glass transition point was measured.

Further, the melting point of a 1:1 mixture of triphenylguanidine and 2,4-dibutylresolcine was determined according to the same manner as in Example 1. The results are all shown in Table 1.

EXAMPLE 4

Two parts of the under-mentioned leuco dye, 18 parts of an addition product of xylileneisocyanate and trimethylolpropane (3:1) were added to a mixed solvent of 24 parts of diisopropyl naphthalene and 5 parts of ethyl acetate and dissolved. This leuco dye solution was mixed in an aqueous solution containing 3.5 parts of polyvinyl alcohol and 1.7 parts of gelatin dissolved in 58 parts of water, and emulsified and dispersed at 20° C. to obtain an emulsion having an average particle diameter of 3μ. 100 parts of water were added to the obtained emulsion, which was heated up to 60° C. with stirring. After 2 hours, a capsule solution containing the leuco dye as a core substance was obtainied.

(Leuco dye)

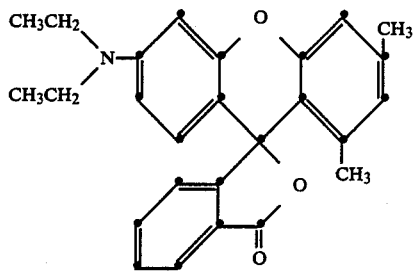

Then, 20 parts of bisphenol A were added to 100 parts of a 5% polyvinyl alcohol aqueous solution and dispersed for about 24 hours using a sand mill to obtain a dispersed solution of bisphenol A having an average particle diameter of 3μ.

Further, 20 parts of p-benzyloyphenol were added to 100 parts of a 5% polyvinyl alcohol aqueous solution and dispersed for about 24 hours using a sand mill to obtain a dispersed solution of p-benzyloxyphenol having an average particle diameter of 3μ.

Five parts of the above capsule solution, 3 parts of the dispersed solution of bisphenol A and 3 parts of the dispersed solution of p-benzyloxyphenol were mixed to prepare a coating solution.

The resulting coating solution was coated on smooth paper of fine quality (50 g/m$^2$) so as to make the dry weight of the coating 7 g/m$^2$. The coating was dried for 30 minutes at 40° C. to obtain a heat sensitive recording material.

The image density was measured with respect to the obtained sample according to the same manner as in Example 1, and the melting point of a 1:1 mixture of bisphenol A and p-benzyloxyphenol was measured. The results are shown in Table 1.

COMPARATIVE EXAMPLE 1

A heat sensitive reacording material and a sample for determining the glass transition point of the wall material of capsules were prepared according to the same manner as in Example 1 except using no p-benzyloxyphenol of Example 1. They were tested and measured in the same manner as in Example 1. Also, the melting point of 2-hydroxy-3-naphthoic acid-3-morpholinopropylamide alone was measured. The obtained results were shown in Table 1.

COMPARATIVE EXAMPLE 2

A heat sensitive recording material and a sample for determining the glass transition point of the wall material of capsules were prepared according to the same manner as in Example 2 except using no p-benzyloxyphenol of Example 2. They were tested and measured in the same manner as in Example 1. Also, the melting point of triphenylguanidine alone was measured. The obtained results are shown in Table 1.

COMPARATIVE EXAMPLE 3

A heat sensitive recording material and a sample for determining the glass transition point of the wall material of capsules were prepared according to the same manner as in Example 3 except using urea instead of p-benzyloxyphenol of Example 3. They were tested and measured. Also, the melting point of a 1:1 mixture of triphenyl guanidine and urea was measured in the same manner as in Example 1. The results are shown in Table 1.

COMPARATIVE EXAMPLE 4

A heat sensitive recording material and a sample for determining the glass transition point of the wall material of capsules were prepared according to the same manner as in Example 3 except using 2,4-dibutyl resorcine instead of p-benzyloxyphenol of Example 3. They were tested and measured in the same manner as in Example 3. The melting point of a 1:1 mixture of triphenylguanidine and 2,4-dibutyl resorcine was also measured in the same manner as in Example 3. The results are shown in Table 1.

COMPARATIVE EXAMPLE 5

A heat sensitive recording material was prepared according to the same manner as in Example 4 except using no p-benzyloxyphenol of Example 4. The image density was measured in the same manner as in Example 1. Also, the melting point of bisphenol A alone was measured. These results are shown in Table 1.

TABLE 1

| Heat Sensitive Recording Material | | Glass Transition Point of the Wall Material of Capsules | | Melting Point of Developer or Color Forming Assistant and Eutectic Point of A Mixture Thereof with Other Additives | | Coloring Characteristics: Image Density | Coloring Characteristics: Density of Nonimage Part |
|---|---|---|---|---|---|---|---|
| Example | 1 | 121° C. | Glass transition point of the wall material containing a plasticizer | 84° C. | Eutectic point with a melting point depressant | 1.27 | 0.10 |
| | 2 | 121° C. | | 93° C. | | 1.25 | 0.10 |
| | 3 | 65° C. | | 58° C. | | 1.24 | 0.13 |
| | 4 | 121° C. | | 108° C. | | 1.26 | 0.11 |
| Comparative Example | 1 | 157° C. | (no plasticizer) | 152° C. | | 0.89 | 0.09 |
| | 2 | 157° C. | (no plasticizer) | 144° C. | | 0.98 | 0.08 |
| | 3 | 65° C. | (with plasticizer) | 142° C. | (mixture with urea) | 0.91 | 0.12 |
| | 4 | 152° C. | (no plasticizer) | 45° C. | (mixture with 2,4-dibutyl-resorcine) | 0.96 | 0.15 |

TABLE 1-continued

| Heat Sensitive Recording Material | Glass Transition Point of the Wall Material of Capsules | Melting Point of Developer or Color Forming Assistant and Eutectic Point of A Mixture Thereof with Other Additives | Coloring Characteristics | |
|---|---|---|---|---|
| | | | Image Density | Density of Nonimage Part |
| 5 | 157° C. (no plasticizer) | 152° C. | 0.88 | 0.10 |

As apparent from Table 1, the heat sensitive recording materials of Example 1, 2, 3 and 4, to which a compound having an effect of greatly lowering the glass transition point of the wall material of microcapsules, and a compound capable of greatly lowering the melting point of a coupling component as a developer or a base as a coloring reaction assistant are added, have higher image densities compared with those of Comparative Example 1, 2 & 5 in which no such additions are added, and those of Comparative Example 3 & 4 to which only a compound having an effect of lowering the glass transition point or only a compound effective to lower lowering the melting point of a base was added. It was proved that the heat sensitive recording material produced according to the present invention is highly excellent compared with traditional ones.

What is claimed is:

1. A heat sensitive recording material produced by providing on a support a heat sensitive layer of microcapsules containing either at least one color former or at least one developer which develops a coloring reaction upon heating, wherein said heat sensitive layer contains a plasticizer for the wall of the microcapsules and a compound having an effect to depress the melting point of said at least one developer which develops the coloring reaction, wherein the plasticizer and melting point depressant are two different compounds.

2. The heat sensitive recording materials claimed in claim 1, wherein said color former is contained in the micocapsules.

3. Heat sensitive recording materials as claimed in claim 2, wherein the wall material of the microcapsules is a macromolecular substance selected from the group consiting of polyurethane, polyurea, polyamide, polyester and polycarbonate.

4. The heat sensitive recording materials claimed in claim 1, wherein the wall material of the microcapsules is a macromolecule substance selected from a group consisting of polyurethane, polyurea, polyamide, polyester and polycarbonate.

5. The heat sensitive recording materials claimed in claim 4, wherein the wall material of the microcapsules is polyurethane or polyurea.

6. The heat sensitive recording materials claimed in claim 1, wherein said plasticizer is at least one member selected from the compounds which reduce the glass transition point of said wall material to 80°–150° C.

7. The heat sensitive recording materials claimed in claim 6, wherein said plasticizer is at least one member selected form a group consisting of phenols, alcohols, ureas, sulfonamides, carbamates and aromatic methoxy compounds.

8. The heat sensitive recording materials claimed in claim 7, wherein said plasticizer is at least one member selected from phenols or sulfonamides.

9. The heat sensitive recording materials claimed in claim 8, wherein said phenols is at least one member selected from that expressed by the following general formula

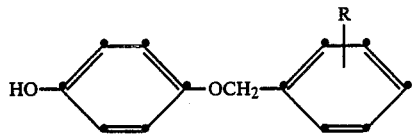

wherein, R represents a hydrogen atom or an alkyl group.

10. The heat sensitive recording materials claimed in claim 9, wherein said R represents a hydrogen atom.

11. The heat sensitive recording materials claimed in claim 8, wherein said sulfonamide is at least one member selected from that expressed by the following general formula

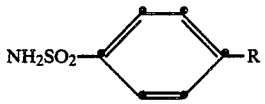

wherein, R represents a hydrogen atom or an alkyl group.

12. The heat sensitive recording materials claimed in claim 11, wherein said R represents methyl group.

13. The heat sensitive recording materials claimed in claim 1 wherein said plasticizer is used inside the microcapsules or in the wall material thereof in an amount of 0.01 to 5.0 parts by weight per one part by weight of said wall material.

14. The heat sensitive recording materials claimed in claim 1 wherein said plasticizer is used outside the microcapsules in an amount of 0.01 to 10 parts by weight per one part by weight of said wall material.

15. The heat sensitive recording materials claimed in claim 1 wherein said melting point depressant is contained in the same place as said developer in an amount of 0.1–2 parts by weight per one part by weight of said developer.

16. Heat sensitive recording materials produced by providing on a support an heat sensitive layer in which three components comprising of at least one color former, one developer and one coloring reaction assistant cooperate to develop a coloring reaction, wherein said heat sensitive layer includes microcapsules containing at leat one component selected from said three components relating to the coloring reaction, or containing either a combination of the color former and the coloring reaction assistant or a combination of the developer and the coloring reaction assistant; also includes a plasticizer for the wall material of the microcapsules and a compound which has an effect of reducing the melting point of at least one of the developers or the coloring reaction assistants relating to the coloring reaction, at least in one of the three places selected from the inside and the outside of the microcapsules and the wall material thereof, wherein the plasticizer and melting point depressant are two different compounds.

17. The heat sensitive recording materials claimed in claim 16, wherein said color former is contained in the microcapsules.

18. The heat sensitive recording materials claimed in claim 16 or claim 17, wherein said wall material of the microcapsules is a macromolecular substance selected from a group of polyurethane, polyurea, polyamide, polyester and polycarbonate.

19. The heat sensitive recording materials claimed in claim 18, wherein said wall material of the microcapsules is polyurethane or polyurea.

20. The heat sensitive recording materials claimed in claim 16, wherein said plasticizer is at least one of the compounds which reduce the glass transition point of said wall material to 80°–150° C.

21. The heat sensitive recording materials claimed in claim 20, wherein said plasticizer is at least one member selected from a group consisting of phenols, alcohols, ureas, sulfonamides, carbamates and aromatic methoxy compounds.

22. The heat sensitive recording materials claimed in claim 21, wherein said plasticizer is at least one member selected from phenols or sulfonamides.

23. The heat sensitive recording materials claimed in claim 22, wherein said phenols is at least one member selected from that expressed by the following general formula:

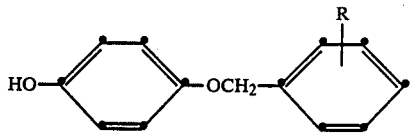

where R represents a hydrogen atom or an alkyl group.

24. The heat sensitive recording materials claimed in claim 23, wherein said R represents a hydrogen atom.

25. The heat sensitive recording materials claimed in claim 22, wherein said sulfonamide is at least one member selected from that expressed by the following general formula:

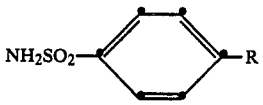

wherein R represents a hydrogen atom or an alkyl group.

26. The heat sensitive recording materials claimed in claim 25, wherein said R represents methyl group.

* * * * *